US006050228A

United States Patent [19]

Garnett et al.

[11] Patent Number: 6,050,228

[45] Date of Patent: Apr. 18, 2000

[54] HYDRO-MECHANICAL FAN DRIVE

[75] Inventors: Stephen C. Garnett, Princevill; Randall A. Harlow, Brimfield, both of Ill.; Alan R. Coutant, Hinckley, United Kingdom

[73] Assignee: Caterpillar Inc., Peoria, Ill.

[21] Appl. No.: 09/130,753

[22] Filed: Aug. 7, 1998

[51] Int. Cl.[7] ..... F01P 7/02

[52] U.S. Cl. ..... 123/41.12

[58] Field of Search ..... 123/41.12, 41.49

[56] References Cited

U.S. PATENT DOCUMENTS

| | | | |
|---|---|---|---|
| 3,853,098 | 12/1974 | Ishikawa et al. | 123/41.11 |
| 3,894,521 | 7/1975 | Sakasegawa et al. | 123/41.12 |
| 4,223,646 | 9/1980 | Kinder | 123/41.11 |
| 4,461,246 | 7/1984 | Clemente | 123/41.12 |
| 4,709,666 | 12/1987 | Merz | 123/41.12 |
| 4,941,437 | 7/1990 | Suzuki et al. | 123/41.12 |
| 5,224,446 | 7/1993 | Okita et al. | 123/41.12 |

FOREIGN PATENT DOCUMENTS

| | | |
|---|---|---|
| 556477 | 8/1993 | European Pat. Off. . |
| 7-11953 | 1/1995 | Japan . |

*Primary Examiner*—Noah P. Kamen
*Attorney, Agent, or Firm*—Haverstock, Garrett & Roberts; Jeffery L. Myers

[57] ABSTRACT

A fan drive is disclosed which includes a planetary gear set having a first rotatable output member connected in driving relation to the fan, a second rotatable output member connected in driving communication with a hydraulic circuit, and a rotatable input member connected in driven communication with a power source, the first and second output members being connected in differentially rotatable communication with the input member. During operation, the hydraulic circuit is operable to vary the rotational speed of the second rotatable output member of the planetary gear set, to thereby vary the rotational speed of the first rotatable output member and the connected fan. According to one preferred aspect of the present invention, the input member of the hydraulic circuit is an input shaft of a hydraulic pump, the rotational speed of the pump being variable by throttling fluid flow therethrough. According to another preferred aspect of the present invention, the hydraulic circuit includes a hydraulic motor connected in driven communication with the second output member of the planetary gear set and in fluid communication with a hydraulic pump to enable power delivered to the hydraulic motor through the planetary gear set to be returned to the power source through the pump.

17 Claims, 3 Drawing Sheets

HYDRO-MECHANICAL FAN DRIVE

TECHNICAL FIELD

This invention relates generally to fan drives, and more particularly, to a hydro-mechanical fan drive utilizing a planetary gear set in cooperation with a hydraulic circuit for achieving variable fan speeds.

BACKGROUND ART

Currently, a wide variety of fan drives are utilized for powering fans for cooling systems of internal combustion engines and the like, including direct engine drives, hydraulic drives, electric drives, and combinations of the above, both through direct connection to the fan and via a variety of clutch arrangements. Reference for instance Ishikawa et al. U.S. Pat. No. 3,853,098 issued Dec. 10, 1974; Sakasegawa et al. U.S. Pat. No. 3,894,521 issued Jul. 15, 1975; Kinder U.S. Pat. No. 4,223,646 issued Sep. 23, 1980; Clemente U.S. Pat. No. 4,461,246 issue Jul. 24, 1984; Merz U.S. Pat. No. 4,709,666 issued Dec. 1, 1987; and Suzuki et al. U.S. Pat. No. 4,941,437 issued Jul. 17, 1990.

In many instances it is desirable to be able to vary the rotational speed of the fan relative to the rotational speed of the engine or other power source therefor, for instance, to reduce fan speed when cooling demand is less. Fan noise is also reduced at lower fan speeds.

Slipping frictional clutches and the like are well known devices utilized for varying fan speed. However, for larger fan applications, such as for cooling large internal combustion engines such as the engines of off-highway trucks and the like, slipping frictional clutches have been found to wear out faster than desired due primarily to the power dissipation requirements to achieve lower fan speed. For instance, some known engine driven cooling fans for such large off-highway trucks operate at rotational speeds of as high as 600 revolutions per minute (rpm) during periods of maximum cooling need, which can require drive power of as much as 150 horsepower. For times when cooling demand is lower, but the rotational speed of the engine remains the same, as much as 50 horsepower may be required to be dissipated, which can rapidly consume frictional wear surfaces of a clutch. Additionally, the power dissipated is typically lost as heat.

Accordingly, the present invention is directed to overcoming one or more of the problems as set forth above.

DISCLOSURE OF THE INVENTION

In one aspect of the present invention, a fan drive is disclosed which includes a planetary gear set having a first rotatable output member connected in driving relation to the fan, and a second rotatable output member and a rotatable input member connected in differentially rotatable communication with the first rotatable output member. A rotatable input member of a hydraulic circuit is connected in driven communication with the second rotatable output member of the planetary gear set, and a rotatable output member of a power source is connected in driving communication with the rotatable input member thereof. During operation, the hydraulic circuit is operable to vary the rotational speed of the second rotatable output member of the planetary gear set, to thereby vary the rotational speed of the first rotatable output member and the connected fan.

According to a preferred aspect of the present invention, the input member of the hydraulic circuit is an input shaft of a hydraulic pump, the rotational speed of the pump being variable by throttling fluid flow therethrough.

According to another preferred aspect of the present invention, the input member of the hydraulic circuit is a shaft of a hydraulic motor connected in fluid communication with a hydraulic pump operable to enable power delivered to the hydraulic motor through the planetary gear set to be returned to the power source through the pump.

BEST MODE FOR CARRYING OUT THE INVENTION

Figure 1:
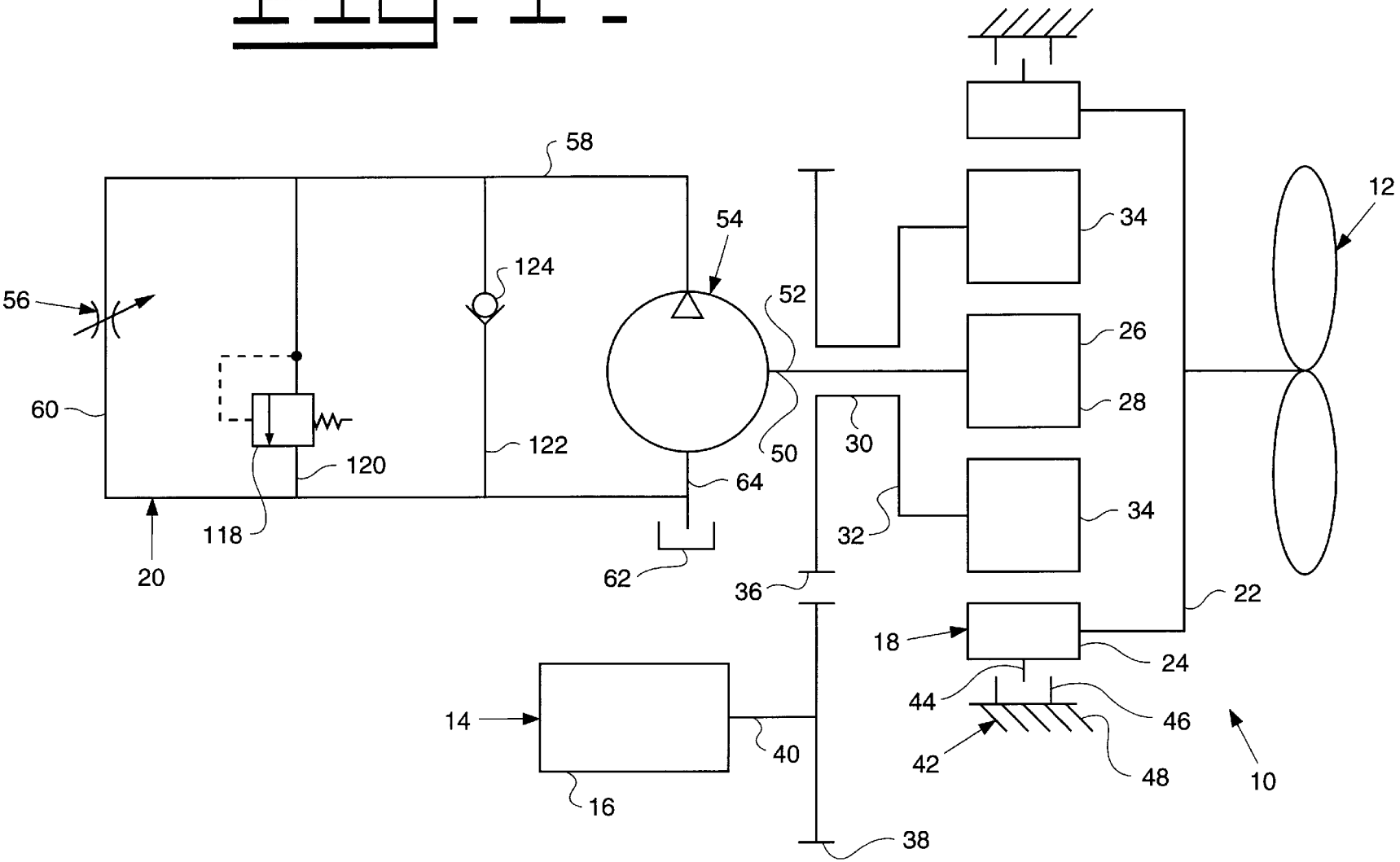
FIG. 1 is a diagrammatic representation of a fan drive according to the present invention.

Referring to the drawings wherein like numerals refer to like parts, FIG. 1 is a diagrammatic representation showing one embodiment 10 of a fan drive constructed and operable according to the teachings of the present invention. Fan drive 10 is shown connected in driving relation to a fan 12 using power from a power source 14. Here, fan 12 represent a cooling fan for the cooling system of an off-highway truck (not shown), and power source 14 is an internal combustion engine 16, both fan 12 and engine 16 being constructed and operable in the conventional manner.

Fan drive 10 includes a planetary gear set 18 and a hydraulic circuit 20. Planetary gear set 18 includes a first rotatable output member 22 including a ring gear 24 connected in driving relation to fan 12; a second rotatable output member 26 including a sun gear 28 connected in driving relation to hydraulic circuit 20; and a rotatable input member 30 including a carrier 32 rotatably supporting a plurality of planet gears 34 enmeshed with ring gear 24 and sun gear 28, first rotatable output member 22 and second rotatable output member 26 being connected in differentially rotatable communication with rotatable input member 30. Rotatable input member 30 additionally includes an input gear 36 mounted to carrier 32 for rotation therewith and enmeshed with an output gear 38 mounted on an output shaft 40 of internal combustion engine 16 for rotation therewith.

Planetary gear set 18 further includes an optional brake assembly 42 which is operable by an operator for slowing and/or stopping rotation of first rotatable output member 22, ring gear 24 and fan 12, the brake assembly including a rotor 44 mounted to ring gear 24 for rotation therewith and a caliper 46 frictionally engagable with rotor 44 mounted to a stationary member 48, the brake assembly being constructed and operable in the conventional manner.

Hydraulic circuit 20 includes a rotatable input member 50 connected in driven communication with second rotatable output member 26 of planetary gear set 18, input member 50 including a rotatable shaft 52 connected in driving communication to a hydraulic pump 54. Hydraulic pump 54 is preferably a variable displacement pump. Pump 54 is connected in fluid communication with an operator operable variable orifice 56 via a fluid supply line 58 on the outlet side of the pump, and via a fluid return line 60 in fluid communication with a reservoir 62 and a suction line 64 in fluid communication with the inlet side of the pump.

In operation, output shaft 40 of internal combustion engine 16 is rotatable to rotate output gear 38 and input gear 36, to rotate carrier 32 of planetary gear set 18. This will result in the rotation of first rotatable output member 22, ring gear 24 and fan 12, depending on resistance to the rotation of sun gear 28 under the control of variable orifice 56. That is, variable orifice 56 is operator operable to throttle or restrict fluid flow through fluid supply line 58 to thereby provide resistance to rotation of pump 54 and shaft 52 thereof, which in turn provides resistance to rotation of sun gear 28. Due to the differentially rotatable relationship of the first and second rotatable output members 22 and 26, as resistance to the rotation of sun gear 28 is increased the rotational speed of the sun gear is de creased and the rotational speed of first rotatable output member 22, ring gear 24 and fan 12 is accordingly increased. Conversely, as resistance to the rotation of sun gear 28 is decreased, the rotational speed thereof will increase, such that the speed of the fan 12 is correspondingly decreased.

Figure 2:
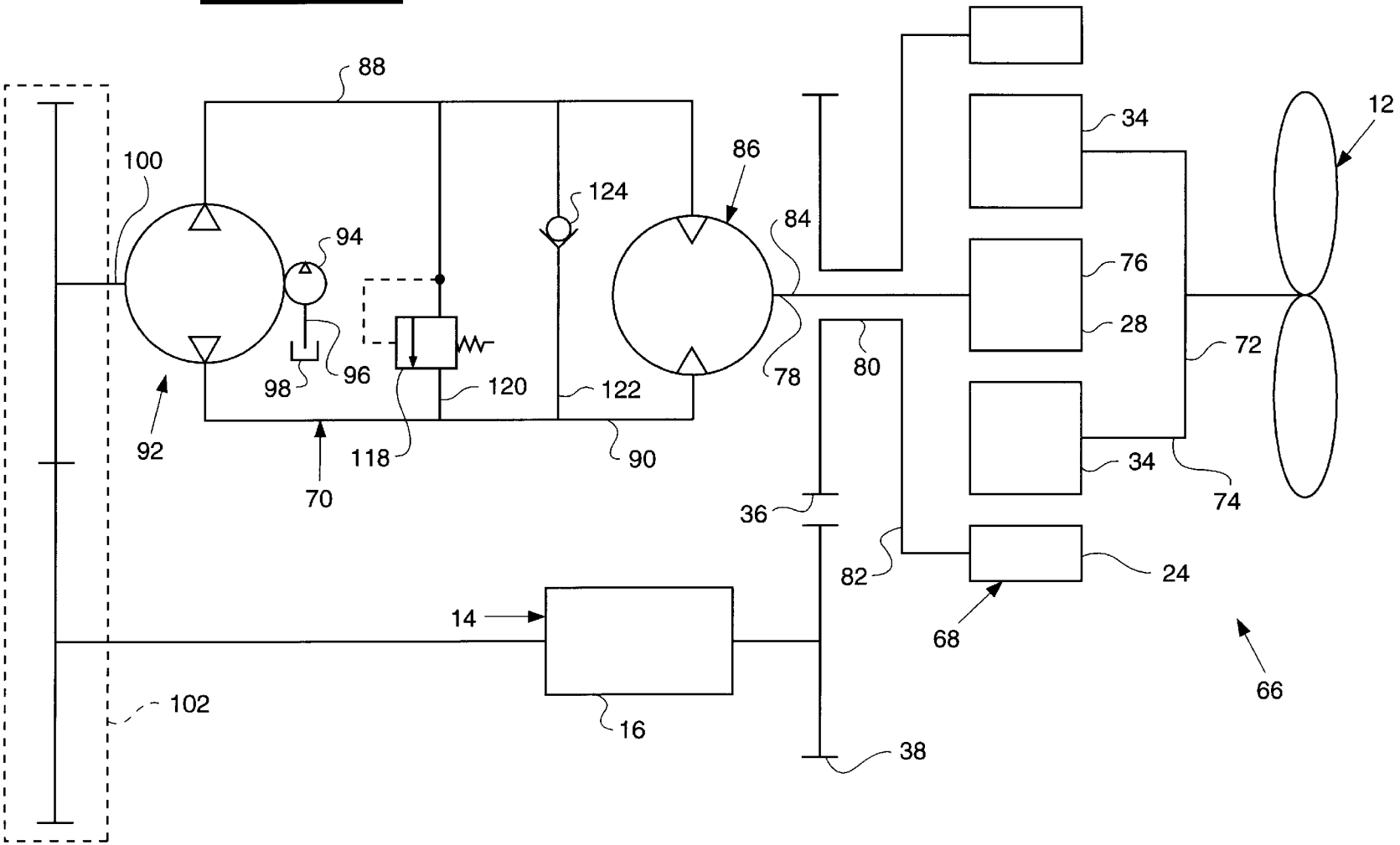
FIG. 2 is a diagrammatic representation of another fan drive according to the present invention.

Turning to FIG. 2, another fan drive embodiment 66 constructed and operable according to the teachings of the present invention is shown. Fan drive 66, like fan drive 10, is operable to drive a fan 12 using power from a power source 14, such as an internal combustion engine 16. Fan drive 66, like fan drive 10, is contemplated for use in cooling systems for large engines, such as those used in large off highway trucks.

Fan drive 66 includes a planetary gear set 68 and a hydraulic circuit 70. Planetary gear set 68 includes a first rotatable output member 72 including a carrier 74 having a plurality of planet gears 34 mounted for rotation thereon, carrier 74 being rotatably connected in driving communication with fan 12. Planetary gear set 68 includes a second rotatable output member 76 including a sun gear 28 rotatably connected in driving relation to a rotatable input member 78 of hydraulic circuit 70. Additionally, planetary gear set 68 includes an input member 80 including a ring gear 24 and an input gear 36 mounted to a carrier 82 for rotation therewith. Input gear 36 is enmeshed with an output gear 38 of internal combustion engine 16 and ring gear 24 is enmeshed with planet gears 34 which are enmeshed with sun gear 28, such that first rotatable output member 72 and second rotatable output member 76 are connected in differentially rotatable communication with input member 80 via planet gears 34.

Rotatable input member 78 of hydraulic circuit 70 is preferably a rotatable shaft 84 of a hydraulic motor 86. Hydraulic motor 86 is preferably a fixed displacement motor and is connected in a closed loop hydrostatic arrangement via a fluid supply line 88 and a fluid return line 90 to a hydraulic pump 92 which preferably has an operator variable displacement. Additionally, hydraulic circuit 70 includes a make-up pump 94 for supplying hydraulic fluid thereto via a suction line 96 in fluid communication with a reservoir 98.

In operation, internal combustion engine 16 rotates output gear 38 to thereby rotate input gear 36, carrier 82 and ring gear 24 of planetary gear set 68. Ring gear 24 in turn rotates planet gears 34, carrier 74 and fan 12, depending on resistance to the rotation of sun gear 28 under operator control using variable displacement pump 92. That is, fixed displacement hydraulic motor 86 effectively operates as a hydraulic pump driven via rotational inputs through shaft 84, and variable displacement hydraulic pump 92 effectively operates as a hydraulic motor driven by hydraulic motor 86 via fluid flow through the hydraulic circuit. When the displacement of pump 92 is controlled so as to be low, resistance to hydraulic fluid flow therethrough will be correspondingly high, thereby creating a high-pressure condition in supply line 88 to resist rotation of motor 86, shaft 84 and sun gear 28. The greater the resistance to the rotation of sun gear 28, the greater the rotational speed of carrier 74 and fan 12. Correspondingly, when the displacement of hydraulic pump 92 is controlled so as to be greater, resistance to fluid flow therethrough will be lower such that pressure conditions in supply line 88 will be lower and resistance to rotation of motor 86, shaft 84 and sun gear 28 will be correspondingly lower. The lower the resistance, the lower the rotational speed of carrier 74 and fan 12.

Additionally, hydraulic pump 92 includes an optional shaft 100 rotatable thereby, shaft 100 being connected in rotatable communication with engine 16 via a suitable convential power transmission mechanism such as gear train 102 shown, such that when pump 92 is rotated by hydraulic motor 86 to provide resistance to rotation of sun gear 28, power transmitted thereto can be transferred via gear train 102 to engine 16.

Figure 3B:
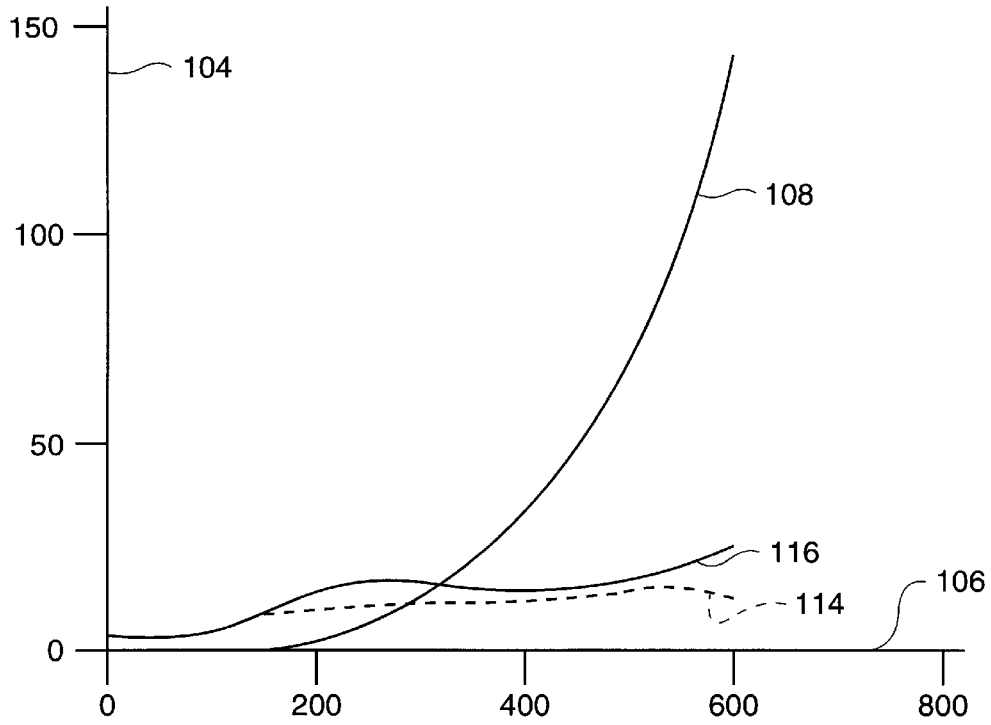
FIG. 3*b* is a graphical representation of horsepower consumption versus fan speed for the fan drive of FIG. 2.
Figure 3A:
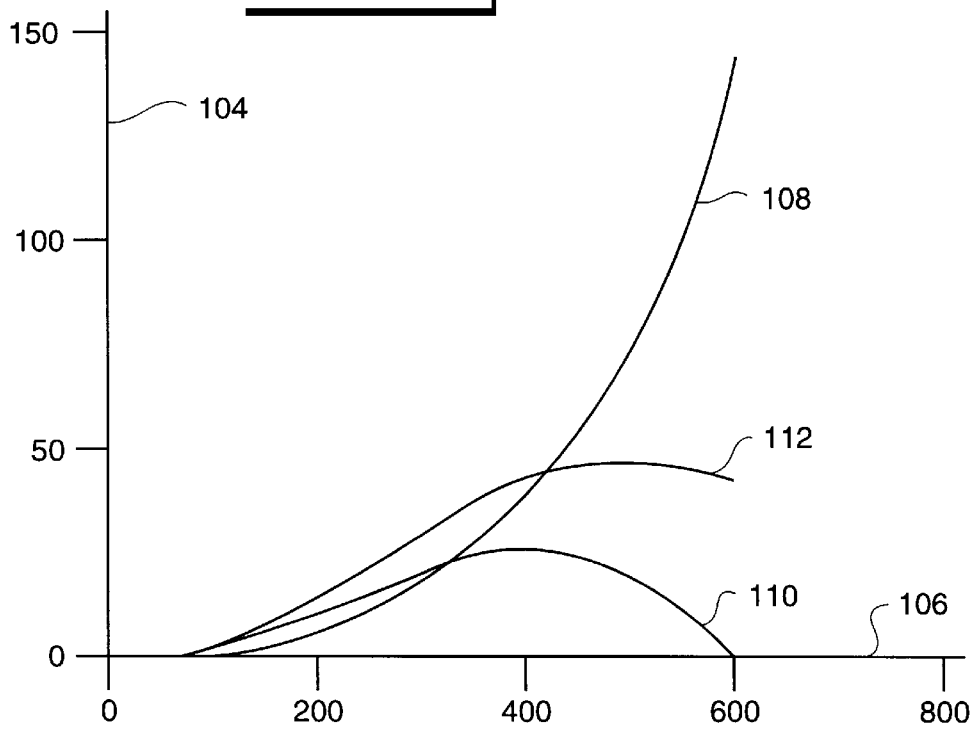
FIG. 3*a* is a graphical representation of horsepower consumption versus fan speed for a typical prior art fan drive utilizing a slipping frictional clutch for varying fan speed.

Referring to FIG. 3*a* and FIG. 3*b*, advantages of the fan drive 66 utilizing planetary gear set 68 and hydraulic circuit 70 for varying fan speed compared to a conventional slipping frictional clutch fan drive are shown. Both FIG. 3*a* and FIG. 3*b* are graphical representations wherein the vertical axis 104 represents power consumption in horsepower and the horizontal axis 106 represents fan rotational speed in revolutions per minute (rpm). Curve 108 in FIG. 3*a* and FIG. 3*b* represents power consumption versus fan speed, for example, in both graphs approximately 150 horsepower being required to rotate the fan at a speed of 600 rpm. In FIG. 3*a* the curve 110 represents power loss for varying fan speed at a constant engine rotational speed of 1500 rpm. Note here that the power loss at the greatest fan speed, 600 rpm, is zero, which is due to a lock up capability of the clutch at that speed. Curve 112 in FIG. 3*a* represents power losses for varying fan speed at a constant engine rotational speed of 1900 rpm. In FIG. 3*b*, curves 114 and 116 show the power losses for varying the fan speed at constant engine rotational speeds of 1500 rpm and 1900 rpm, respectively. As can be seen from a general comparison of FIG. 3*b* and FIG. 3*a*, the power loss curves for varying fan speed using fan drive 66 are flatter than those for the slipping frictional clutch. Comparing curves 112 and 116 representing power losses at 1900 rpm, it can be seen that power losses using fan drive 66 are considerably less at the higher engine operating speed. This is due in part to the ability of pump 92 of hydraulic circuit 70 to recycle some of the power to engine 16 via gear train 102, which is a significant advantage over known systems using slipping frictional clutches. It has also been found that when utilizing a fan drive according to the present invention including a planetary gear set operable in cooperation with a hydraulic circuit as disclosed herein, the problem of wear and consumption of frictional materials is not present.

Referring again to FIG. 1 and FIG. 2, in the instance of both fan drive 10 and fan drive 66, sometimes hydraulic circuits 20 and 70 can be subjected to operating pressure conditions beyond their capacity. Therefore, to avoid damage to the hydraulic circuits, both circuits 20 and 70 can optionally include a relief valve 118 in a bypass line 120 connected between the respective fluid supply line and fluid return line thereof and operable at a predetermined high pressure condition to allow fluid flow therebetween. Additionally, both hydraulic circuits 20 and 70 can optionally include a second bypass line 122, connected between the respective fluid supply line and return line thereof, and including a check valve 124 operable to allow fluid flow in the reverse direction through the respective pump 54 and motor 86 in the event sun gear 28 of the related planetary gear set is rotated in the reverse direction.

INDUSTRIAL APPLICABILITY

The present hydro-mechanical fan drive has utility for use in a wide variety of applications wherein variable fan speed, efficiency, reliability and longevity are desired.

Other aspects, objects and advantages of the present invention can be obtained from a study of the drawings, the disclosure and the appended claims.

We claim:

1. A fan drive, comprising:

a planetary gear set having a first rotatable output member adapted for connection in driving relation to the fan, a second rotatable output member, and a rotatable input member, the first rotatable output member and the second rotatable output member being connected in differentially rotatable communication with the rotatable input member;

wherein the first rotatable output member of the planetary gear set comprises a ring gear;

an operator operable brake for controlling the rotation of the ring gear;

a hydraulic circuit having an input member connected in driven communication with the second rotatable output member of the planetary gear set;

a power source having a rotatable output member connected in driving communication with the rotatable input member of the planetary gear set;

wherein the hydraulic circuit is operable to provide variable resistance to the rotation of the second rotatable output member of the planetary gear set to vary the rotational speed of the first rotatable output member thereof.

2. The fan drive, as set forth in claim 1, wherein the hydraulic circuit comprises a member operable as a hydraulic pump and a member operable for varying flow of fluid therethrough, the member operable as the hydraulic pump having an input shaft comprising the input member of the hydraulic circuit, and the resistance to the rotation of the input member of the hydraulic circuit being variable using the member operable for varying the flow through the member operable as the hydraulic pump.

3. The fan drive, as set forth in claim 2, wherein the member operable for varying the flow through the member operable as the hydraulic pump comprises an operator operable variable orifice connected in fluid communication with the member operable as the hydraulic pump.

4. The fan drive, as set forth in claim 3, wherein the first output member of the planetary gear set comprises a ring gear, the second output member of the planetary gear set comprises a sun gear, and the input member of the planetary gear set comprises a planet gear carrier rotatably supporting a plurality of planet gears enmeshed with the ring gear and the sun gear.

5. The fan drive, as set forth in claim 2, wherein the hydraulic circuit further comprises a pressure relief valve connected in fluid communication with the member operable as the hydraulic pump for relieving predetermined high-pressure conditions in the hydraulic circuit.

6. The fan drive, as set forth in claim 1, wherein the second rotatable output member of the planetary gear set comprises a sun gear.

7. The fan drive, as set forth in claim 1, wherein the rotatable input member of the planetary gear set comprises a planet gear carrier.

8. The fan drive, as set forth in claim 1, wherein the power source comprises an internal combustion engine.

9. The fan drive, as set forth in claim 1, wherein the hydraulic circuit comprises a hydraulic motor connected in fluid communication with a hydraulic pump.

10. The fan drive, as set forth in claim 9, wherein the hydraulic pump is an operator operable variable displacement pump and the hydraulic motor is a fixed displacement hydraulic motor, the hydraulic pump and the hydraulic motor being connected in a closed hydrostatic loop.

11. The fan drive, as set forth in claim 10, wherein the planetary gear set comprises a sun gear and the input member of the hydraulic circuit comprises an input shaft of the hydraulic motor connected in driven communication with the sun gear.

12. The fan drive, as set forth in claim 10, wherein the hydraulic circuit further comprises a make-up pump for providing hydraulic fluid thereto.

13. The fan drive, as set forth in claim 10, wherein the hydraulic pump comprises a rotatable shaft connected in rotatable communication with the power source.

14. The fan drive, as set forth in claim 1, wherein the rotatable input member of the planetary gear set comprises a ring gear.

15. The fan drive, as set forth in claim 1, wherein the first rotatable output member of the planetary gear set comprise a planet gear carrier rotatably supporting a plurality of planet gears, the second rotatable output member of the planetary gear set comprises a sun gear, and the rotatable input member of the planetary gear set comprises a ring gear, the planet gears being enmeshed with both the sun gear and the ring gear.

16. The fan drive, as set forth in claim 1, further comprising a fan connected to the first rotatable output member of the planetary gear set.

17. The fan drive, as set forth in claim 1, wherein the second rotatable output member of the planetary gear set comprises a sun gear and the input member of the hydraulic circuit connected in driven communication with the second rotatable output member comprises a rotatable shaft of a member operable as a hydraulic pump and the hydraulic circuit further comprises a member operable as a hydraulic motor connected in a hydrostatic loop with the member operable as the hydraulic pump, the member operable as the hydraulic motor having a shaft connected in rotatable communication with the power source.

* * * * *